US009377763B2

(12) United States Patent
Fujisawa

(10) Patent No.: US 9,377,763 B2
(45) **Date of Patent: *Jun. 28, 2016**

(54) TIMEPIECE WITH WIRELESS COMMUNICATION FUNCTION

(71) Applicant: Seiko Epson Corporation, Tokyo (JP)

(72) Inventor: Teruhiko Fujisawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/155,497

(22) Filed: Jan. 15, 2014

(65) Prior Publication Data

US 2014/0126337 A1 May 8, 2014

Related U.S. Application Data

(63) Continuation of application No. 13/872,624, filed on Apr. 29, 2013, now Pat. No. 8,665,675, which is a continuation of application No. 12/828,600, filed on Jul. 1, 2010, now Pat. No. 8,456,959.

(30) Foreign Application Priority Data

Jul. 14, 2009 (JP) ..... 2009-165503

(51) Int. Cl.
*G04R 60/12* (2013.01)
*G04R 60/08* (2013.01)
*G04R 60/06* (2013.01)

(52) U.S. Cl.
CPC ..... *G04R 60/08* (2013.01); *G04R 60/06* (2013.01); *G04R 60/12* (2013.01)

(58) Field of Classification Search
CPC ..... G04R 60/12
See application file for complete search history.

(56) References Cited

U.S. PATENT DOCUMENTS

| | | | | |
|---|---|---|---|---|
| 4,637,734 | A | 1/1987 | Gogniat | |
| 5,627,548 | A * | 5/1997 | Woo | G01S 19/34 342/352 |
| 5,790,477 | A | 8/1998 | Hauke | |
| 5,798,984 | A | 8/1998 | Koch | |
| 6,542,120 | B1 * | 4/2003 | Gilbertson | G01S 19/34 342/357.64 |
| 6,657,922 | B2 | 12/2003 | Sato | |
| 6,813,223 | B1 | 11/2004 | Born et al. | |
| 7,190,638 | B2 | 3/2007 | Oguchi | |

(Continued)

FOREIGN PATENT DOCUMENTS

| | | | |
|---|---|---|---|
| CH | 343948 | A | 12/1959 |
| CH | 1054864 | A | 3/1967 |

(Continued)

OTHER PUBLICATIONS

EP Search Report, application No. 10169226.7, dated Oct. 21, 2011.

*Primary Examiner* — Amy Cohen Johnson
*Assistant Examiner* — Jason Collins

(57) ABSTRACT

A timepiece with a wireless function comprises a movement that is configured to display time; a conductive case that is configured to hold the movement; a crystal that is disposed on a face side of the case and is configured covers a face side of the movement; an antenna that has a substantially annular, conductive antenna electrode and is disposed between the movement and the crystal as seen in a lateral view; and a ring member that is made of non-conductive material and is configured to cover the antenna.

9 Claims, 12 Drawing Sheets

(56) References Cited

U.S. PATENT DOCUMENTS

| | | | | |
|---|---|---|---|---|
| 7,396,155 | B2 | 7/2008 | Oguchi | |
| 8,107,324 | B2 | 1/2012 | Kojima | |
| 2004/0150578 | A1* | 8/2004 | Nomura et al. | 343/788 |
| 2006/0280041 | A1* | 12/2006 | Verdon et al. | 368/296 |
| 2007/0076531 | A1* | 4/2007 | Schiavolini | 368/291 |
| 2008/0018547 | A1 | 1/2008 | Iwasaki | |
| 2008/0030403 | A1* | 2/2008 | Honda | G01S 19/14 342/357.52 |
| 2010/0164818 | A1 | 7/2010 | Kusunoki et al. | |
| 2011/0013491 | A1 | 1/2011 | Fujisawa | |
| 2013/0242711 | A1 | 9/2013 | Fujisawa | |
| 2014/0126337 | A1 | 5/2014 | Fujisawa | |

FOREIGN PATENT DOCUMENTS

| | | | |
|---|---|---|---|
| CH | 659561 | A | 2/1987 |
| EP | 1315052 | A1 | 5/2003 |
| EP | 1522908 | A1 | 4/2005 |
| EP | 2058716 | A1 | 5/2009 |
| JP | 3-074395 | U | 7/1991 |
| JP | 05-264750 | | 10/1993 |
| JP | 08-307141 | | 11/1996 |
| JP | 10-160872 | | 6/1998 |
| JP | 2000-059241 | | 2/2000 |
| JP | 2001-024680 | | 1/2001 |
| JP | 2001-027680 | | 1/2001 |
| JP | 2005-274247 | | 10/2005 |
| JP | 2006-013798 | | 1/2006 |
| JP | 2008-205531 | | 9/2008 |
| JP | 2008-211719 | | 9/2008 |
| JP | 2009-168656 | | 7/2009 |
| JP | 5493527 | | 3/2014 |
| WO | 00/03310 | | 1/2000 |

* cited by examiner

TIMEPIECE WITH WIRELESS COMMUNICATION FUNCTION

CONTINUING APPLICATION DATA

This application is a continuation of, and claims priority under 35 U.S.C. §120 on, U.S. application Ser. No. 13/872,624, filed Apr. 29, 2013, which is a continuation of U.S. application Ser. No. 12/828,600, filed Jul. 1, 2010, now U.S. Pat. No. 8,456,959, which claims priority under 35 U.S.C. §119 on Japanese patent application no. 2009-165503, filed Jul. 14, 2009. The content of each such related application is incorporated by reference herein in its entirety.

BACKGROUND

1. Field of Invention

The present invention relates to a timepiece with a wireless communication function for receiving radio frequency signals.

2. Description of Related Art

Timepieces that have a wireless communication function are known from the literature. One use for such wireless communication functions is receiving signals from positioning information satellites such as GPS (Global Positioning System) satellites to detect the current position.

When a wireless communication function is rendered in a wristwatch as such a timepiece with a wireless communication function, an antenna with sufficient reception performance must be rendered in a confined space.

Wristwatches that can function as a reception terminal in a satellite communication system, and wristwatches with a function for sending and receiving RF transmission signals, are taught in Japanese Unexamined Patent Appl. Pub. JP-A-2000-59241, Japanese Unexamined Patent Appl. Pub. JPA-2001-27680, and Japanese Unexamined Patent Appl. Pub. JP-A-H10-160872.

In the wristwatch taught in JP-A-2000-59241, a C-shaped loop antenna with a dielectric substrate is disposed around the display unit, and the metal case member of the wristwatch is used as a ground plate.

In the wristwatch taught in JP-A-2001-27680, a GPS antenna is disposed beside the display unit of the wristwatch. The GPS antenna is affixed to the metal wristwatch case with double-sided tape.

In the wristwatch taught in JP-A-H10-160872, the antenna and communication circuit are together rendered in a plastic bezel, and a communication mechanism can be easily added to the wristwatch by simply installing the bezel. The antenna is covered by the bezel and cannot be seen from the outside.

In addition to practical functions such as displaying the time and communication functions, a high quality appearance is also desirable in a timepiece. This is particularly true for analog wristwatches.

Metal materials with a precision finish are commonly used for the case, dial, and other external parts of such timepieces. Functional elements such as communication antennas in particular must be covered or rendered internally so that they do not detract from the external appearance.

With the timepieces taught in JP-A-2000-59241 and JPA-2001-27680, the communications antenna is large and exposed beside the display unit, and cannot be used if a quality appearance is also a consideration.

The configuration taught in JP-A-H10-160872 largely obviates appearance-related problems, but cannot assure sufficient antenna performance. More specifically, the communications antenna is not exposed but a ground plate cannot be assured.

In addition, while a metal case and dial are desirable for appearance considerations, their conductivity also makes them function as an electromagnetic shield blocking RF signals from the inside. As a result, when the antenna is disposed inside a metal case and dial, sufficient antenna performance cannot be achieved.

SUMMARY OF INVENTION

A timepiece with a wireless function according to the present invention can simultaneously assure a good appearance and good antenna performance.

A first aspect of the invention is a timepiece with a wireless function, including a movement that displays time; a conductive case that holds the movement; a crystal that is disposed on a face side of the case and covers a face side of the movement; an antenna that has a substantially annular, conductive antenna electrode and is disposed between the movement and the crystal as seen in a lateral view; and a ring member that is made of non-conductive material and covers the antenna.

The antenna is preferably formed in the shape of a ring, rectangle, or one that matches the shape of the timepiece. A ring-shaped antenna includes a shape of which part of the ring is missing, such as a C-shaped antenna.

A conductive plate may be disposed on the face side of the timepiece that is covered by the crystal, such as where the dial appears in a normal wristwatch design. Particularly with a wristwatch, the case is preferably metal to improve the appearance of the timepiece. Such a configuration impedes the input of RF signals from the sides and back cover parts of the timepiece, and RF signals can only enter from the crystal side. By disposing the conductive plate on the face side of the timepiece where the crystal is located, input RF signals can be reflected to the antenna electrode and received. In this arrangement, the conductive plate may be disposed between the movement and the crystal. Because the distance between the movement and the crystal is sufficient to accommodate the staff supporting the hands, there is enough space inside the case to accommodate the conductive plate. The area of the conductive plate can therefore be increased, more radio waves can be reflected by the conductive plate and input to the antenna electrode, and good antenna performance can be assured.

The antenna electrode is preferably configured so that it can receive more radio waves, and is therefore as long as possible. Using an antenna with an O-shaped or C-shaped substantially annular antenna electrode can dispose the antenna electrode around the outside edge of the conductive plate or timepiece, can increase the signal reception area of the antenna compared with a rod-like antenna or an arc-shaped antenna, and can therefore improve signal reception. In addition, the outside shape of the conductive plate, if employed, may be substantially the same as the shape of the inside circumference of the case. In this configuration the space on the inside circumference side of the conductive plate can be used effectively because the antenna electrode can be located around the outside edge of the timepiece.

Furthermore, because the antenna can thus be disposed around the outside edge of the conductive plate, if employed, the antenna can be easily hidden by a separate non-conductive member such as a dial ring. Problems such as the antenna being exposed at the timepiece surface and detracting from the timepiece appearance can therefore be easily avoided, and the high quality appearance of the timepiece can be maintained.

As a result, a timepiece with a wireless function having good antenna performance and a high quality appearance can be provided.

In a timepiece with a wireless function according to another arrangement, the antenna may have an annular dielectric substrate disposed along the outside edge of a conductive plate, and the antenna electrode is disposed on the dielectric substrate. A part of the annular dielectric substrate is disposed between the dial and the crystal as seen in the lateral view.

The antenna electrode may be disposed on an annular dielectric substrate. In general, the antenna electrode must be at least as long as the wavelength of the signals to be received, and assuring sufficient antenna electrode length in a wristwatch or other small timepiece is difficult.

Therefore, by disposing the antenna electrode on a dielectric substrate, the wavelength of input RF signals can be shortened by the dielectric substrate, and RF signals of a specific wavelength can be received by an antenna electrode that is shorter than the signal wavelength. In addition, because the dielectric substrate is formed in a ring shape, it can be disposed along the outside of the conductive plate so that it does not detract from the appearance of the timepiece.

A timepiece with a wireless function may have a transparent dial for displaying time, and a solar panel that receives light and produces electrical power, and is disposed between the dial and the movement. In this arrangement, the conductive plate is a solar panel support substrate that supports the solar panel.

When a solar panel is included, the solar panel support substrate that supports the solar panel can also be used as the conductive plate that reflects RF signals, and the construction of the timepiece can be further simplified. Furthermore, by disposing the antenna along the outside of the solar panel support substrate, the solar panel can cover the entire area on the inside circumference side of the solar panel. A solar panel with a sufficiently large surface area and good photovoltaic efficiency can therefore be used.

In a timepiece with a wireless function, the ring member is preferably a dial ring, and any conductive plate may be a dial for displaying time.

Such a dial provides a good appearance, and can also simplify timepiece construction. In addition, because the antenna is disposed around the outside edge of the dial, problems such as indicia on the dial being hidden by the antenna are prevented, and the legibility and appearance of the dial can be balanced with good antenna performance.

In a timepiece with a wireless function, the case may have a signal reflection surface that is disposed to least one part of the end thereof on the crystal side and reflects signals entering from the crystal side to the antenna, and the conductive plate is disposed with the outside edge thereof in contact with the inside circumference surface of the case.

In this arrangement, a RF reflection surface is formed on one end of a conductive case. As a result, signals can be reflected by this RF reflection surface and guided to the antenna electrode, and antenna performance can be further improved. In addition, the outside edge of the conductive plate is disposed in contact with the case so that there is no gap between the conductive plate and the case, thereby achieving the same effect as when the conductive plate extends to the outside circumference side, and more radio waves can therefore reflected to the antenna electrode. The reception sensitivity of the antenna can therefore be further improved.

In a timepiece with a wireless function, the crystal may have a face part that covers the face side of the movement when the timepiece with wireless function is seen in sectional view through the thickness of the timepiece, and a side part that is rendered around the outside circumference of the face part with the end surface thereof fastened to the case, the end surface of the side part being fastened to the case at a position closer to the movement side than at least the top surface of the antenna opposing the face part. Preferably, the crystal extends to the side of the movement from a location where the antenna electrode is disposed. In at least one embodiment, the crystal is printed to the inside surface at a position overlapping the antenna a non-conductive ink.

In this arrangement, the end face of the side part of the crystal is closer to the movement than the top surface of the antenna, and more preferably is substantially flush with the conductive plate. With this configuration signals input from the side of the timepiece can also be received by the antenna electrode without being affected by the conductive case. The antenna electrode can therefore be made to receive more radio waves, and antenna performance can be further improved. Furthermore, this aspect of the invention can achieve the luxury feel that is unique to glass by covering a large area on the face side of the timepiece with the crystal instead of affixing the crystal to the case through a separate intervening member such as a ceramic bezel, for example, and a timepiece with a luxury appearance can be provided.

In a timepiece with a wireless function, the antenna may have an annular dielectric substrate disposed along the outside edge of the conductive plate; the antenna electrode includes a substantially annular main antenna unit disposed on the top surface of the dielectric substrate opposite the crystal, one or more coupling units that branch to a side of the dielectric substrate from one or more junction nodes disposed to part of the main antenna unit, and a power supply node that is formed contiguously to an opposite end of the coupling unit as the junction node on the bottom side of the dielectric substrate opposite the movement; the conductive plate has a through-opening passing through the conductive plate in the timepiece thickness direction at a position opposite the power supply node; and the timepiece further comprises a connection member that passes through the through-opening in the conductive plate, contacts the power supply node without contacting the conductive plate, and transmits to a reception unit that processes the reception signal based on the radio waves received by the antenna.

With this aspect signals received by the main antenna unit are transmitted to the signal processing circuit through a connection member from a power supply unit disposed to the bottom of the dielectric substrate. Because the conductive plate has a through-opening opposite the power supply unit, the power supply unit and the conductive plate do not touch and the connection member does not touch the conductive plate, and signals received by the antenna electrode can be transmitted from the connection member to the signal processing circuit without escaping to the conductive plate.

In a timepiece with a wireless function, the antenna may receive circularly polarized waves.

Examples of circularly polarized waves include satellite signals transmitted from positioning information satellites such as those in the Global Positioning System (GPS), Galileo (the European satellite navigation system), and Satellite-Based Augmentation System (SBAS). Such satellite signals can be received anywhere on Earth from the positioning information satellites. Therefore, if the timepiece has a function for adjusting the time using time information carried in the satellite signal, the signals from the positioning information satellites can be reliably received anywhere in the world, and the correct time can always be maintained.

The timepiece with a wireless function preferably further includes a a bezel that is made of non-conductive material and is disposed between the case and the crystal.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 9A shows a configuration in which the diameter of the solar panel support substrate is large, and FIG. 9B shows a configuration in which the diameter of the solar panel support substrate is small.

DESCRIPTION OF THE PREFERRED EMBODIMENTS

Preferred embodiments of the present invention are described below with reference to the accompanying figures.

First Embodiment

A first embodiment of the invention is described next with reference to FIG. 1 to FIG. 5.

Figure 1:
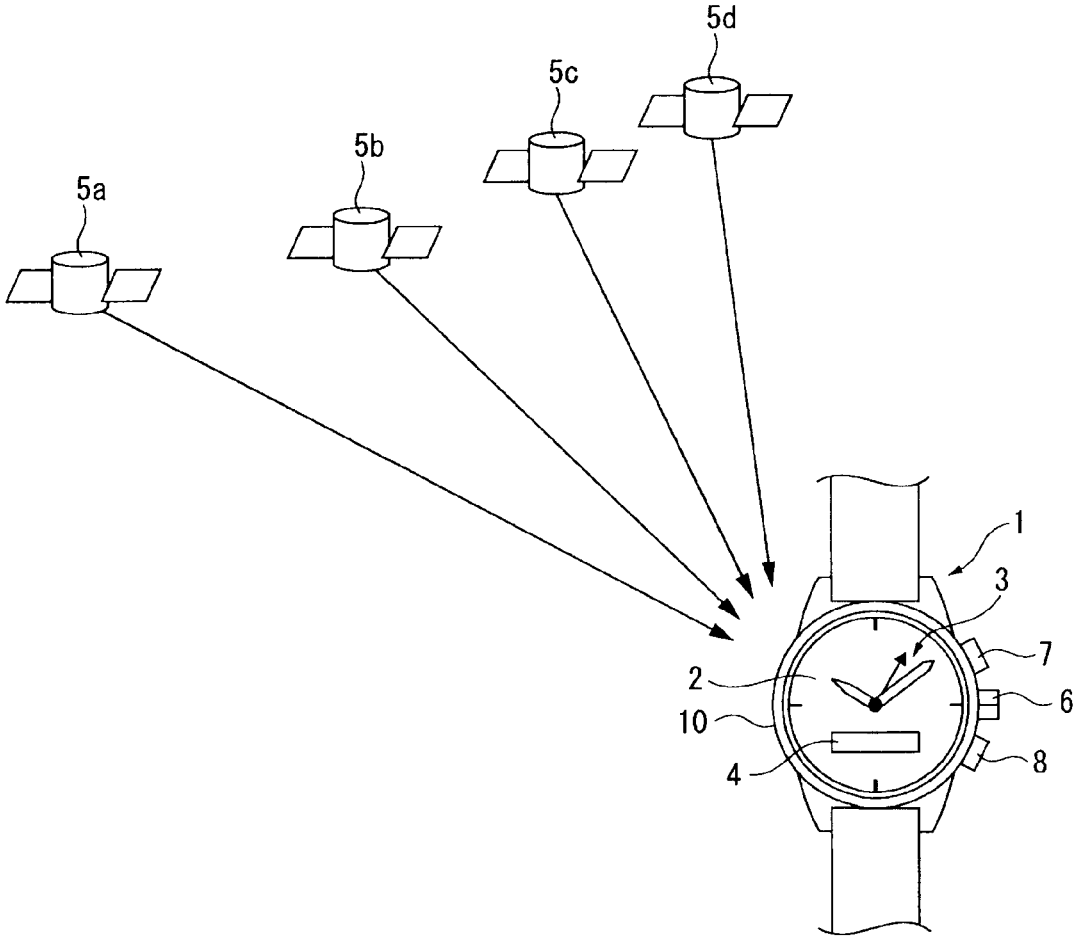
FIG. 1 shows a GPS wristwatch according to a preferred embodiment of a timepiece with a wireless function according to the invention.
Figure 2:
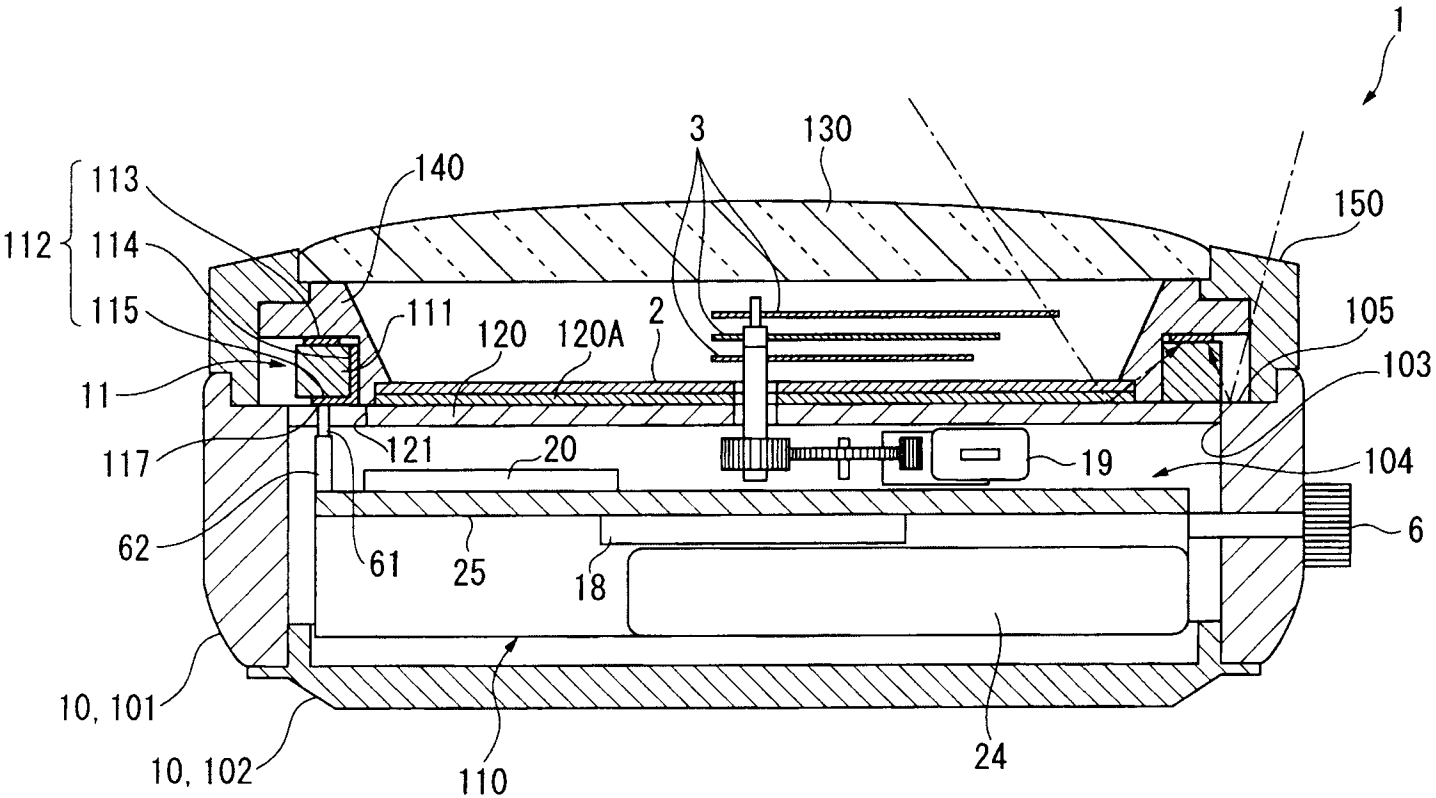
FIG. 2 is a sectional view of a GPS wristwatch according to a preferred embodiment of the invention.
Figure 3:
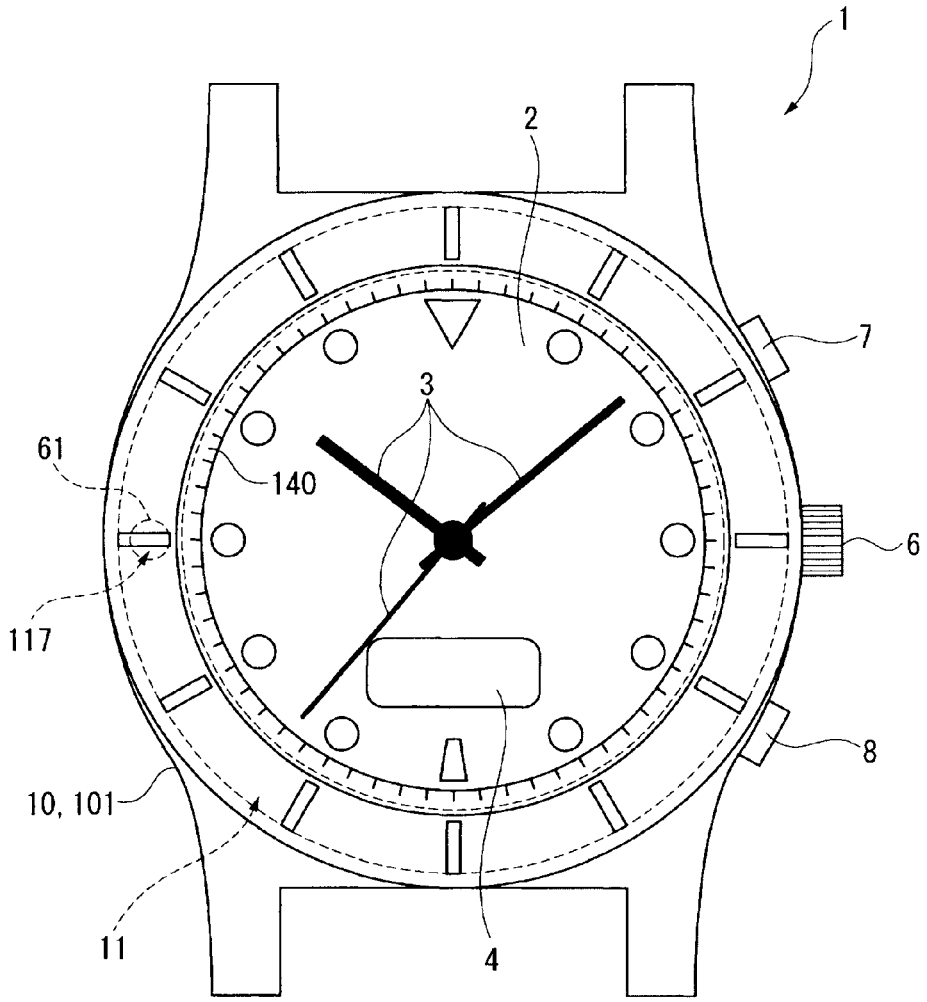
FIG. 3 is an enlarged view of a GPS wristwatch according to a preferred embodiment of the invention.
Figure 4:
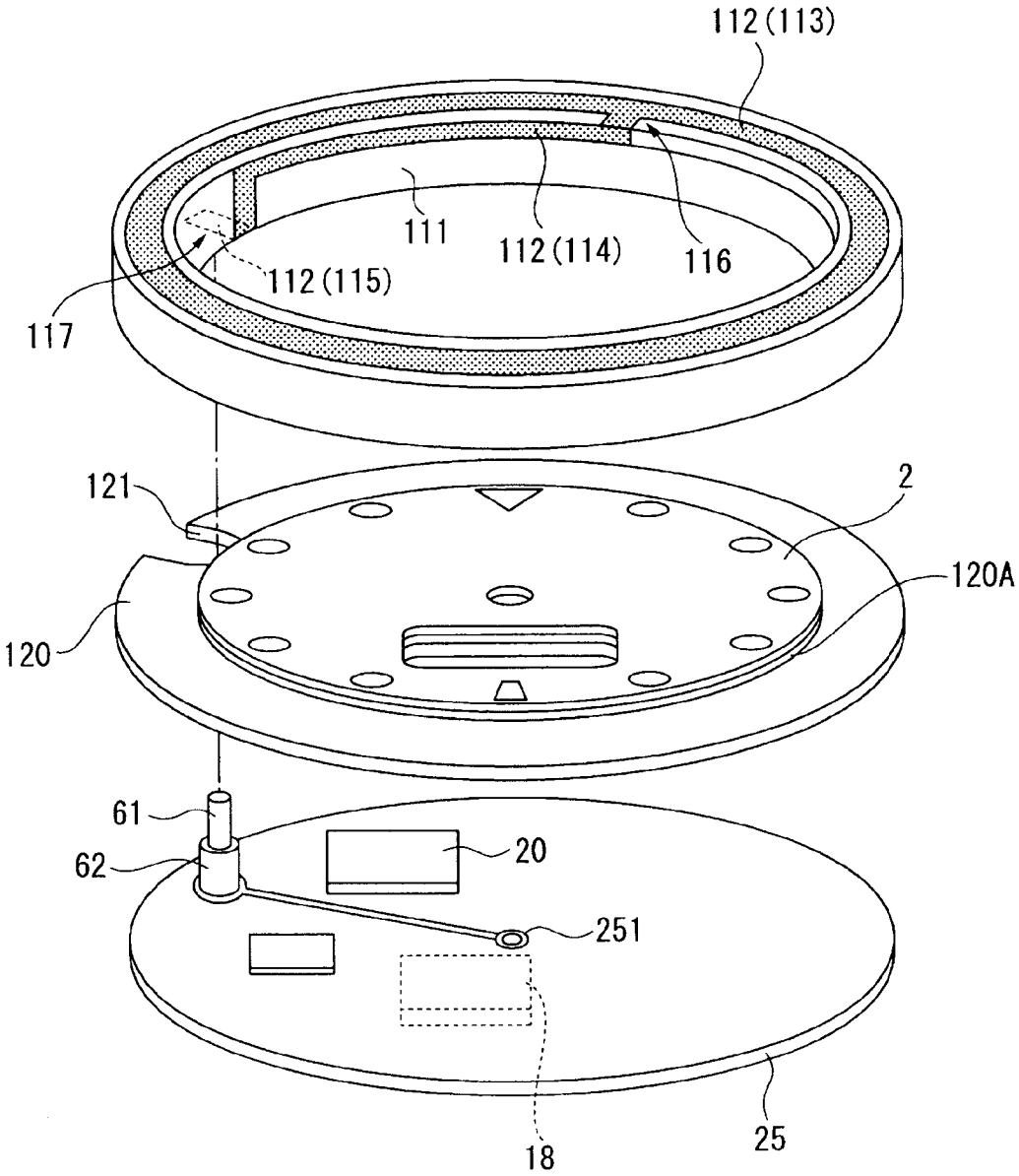
FIG. 4 is an oblique exploded view of the GPS antenna disposed in a GPS wristwatch according to a preferred embodiment of the invention.
Figure 5:
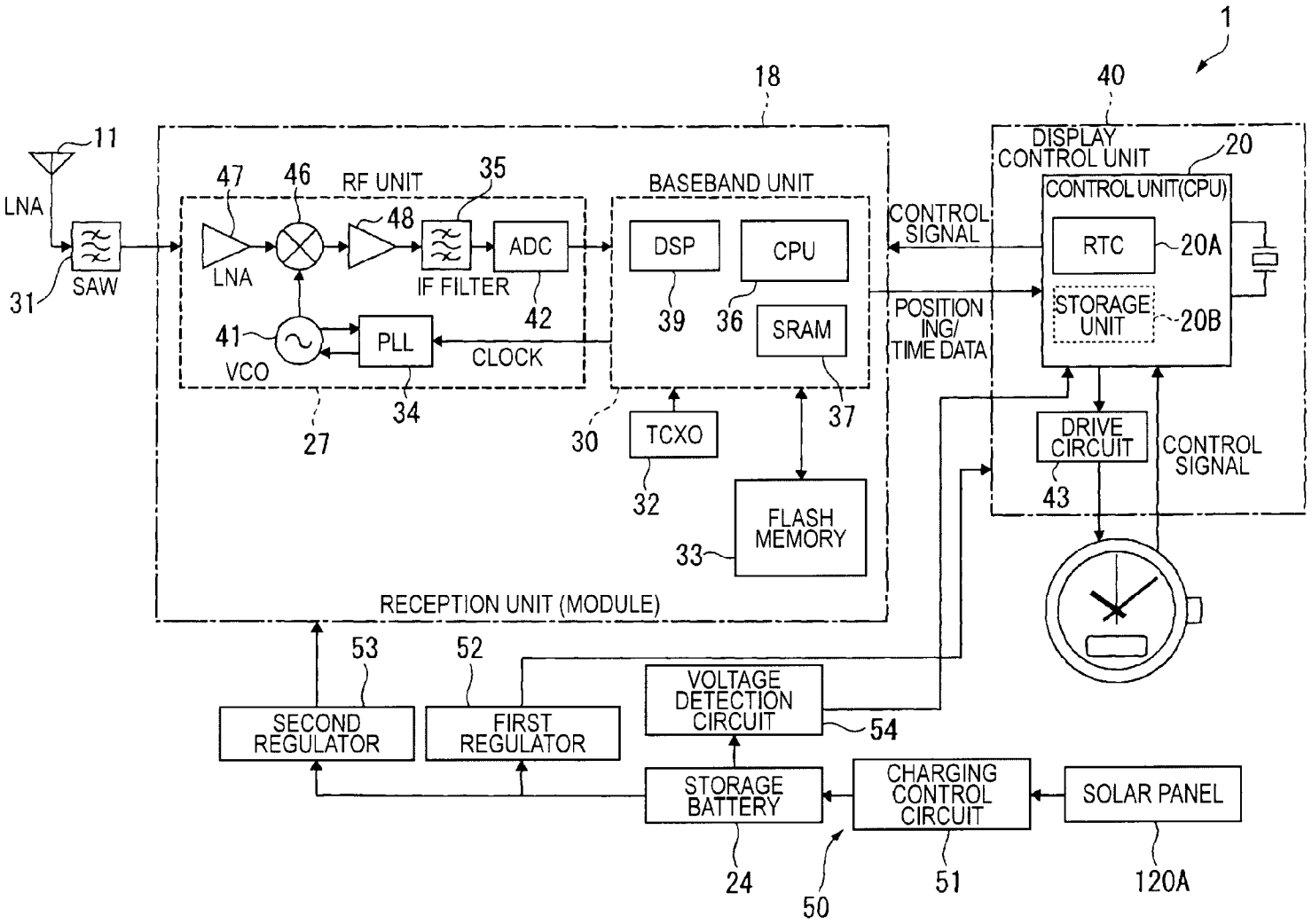
FIG. 5 is a block diagram showing the main hardware configuration of a GPS wristwatch according to a preferred embodiment of the invention.

FIG. 1 shows a wristwatch with a GPS time adjustment device 1 (referred to herein as a "GPS wristwatch 1") with a wireless function according to a preferred embodiment of the invention. FIG. 2 is a sectional view of the GPS wristwatch 1. FIG. 3 is an enlarged view of the GPS wristwatch 1, and FIG. 4 is an oblique exploded view of the GPS antenna disposed in the GPS wristwatch 1. FIG. 5 shows the main hardware configuration of the GPS wristwatch 1.

As shown in FIG. 1, the GPS wristwatch 1 has a time display unit including a dial 2 and hands 3. A window is formed in a part of the dial 2, and an LCD display panel or other type of display 4 is presented in this window.

The hands 3 include a second hand, minute hand, and hour hand, and are driven through a drive mechanism including a wheel train and stepping motor as described below.

The display 4 is an LCD display panel in this embodiment of the invention, and presents positioning information such as the latitude and longitude or a city name, and other types of messages and information.

The GPS wristwatch 1 is configured so that it can receive satellite signals and acquire satellite time information from a plurality of GPS satellites 5*a*, 5*b*, 5*c*, 5*d* orbiting the Earth on specific orbits, and can adjust the internally kept time based on the received time information.

Note that the GPS satellites 5*a*, 5*b*, 5*c*, 5*d* are one example of positioning information satellites in the invention, and many GPS satellites are in orbit. At present, there are approximately 30 GPS satellites 5*a*, 5*b*, 5*c*, 5*d* in orbit.

The GPS wristwatch 1 also has a crown 6 and buttons 7 and 8 for externally operating the GPS wristwatch 1.

Internal Configuration of a GPS Wristwatch

As shown in FIG. 2 and FIG. 3, the GPS wristwatch 1 has a movement 110 that drives the hands 3, and a case 10 that houses the movement 110.

The case 10 includes a cylindrical external case member 101 and a back cover 102 that covers one of the openings in the case member 101 (the opening on the bottom side as seen in FIG. 2).

Brass, stainless steel, titanium alloy, or other type of electrically conductive metal material is used for the case member 101 and back cover 102. The back cover 102 is connected to the case member 101 by a screw thread. This forms a cavity 104 inside the case 10 with an open face 103 on the opposite side of the case member 101 (the top side of the case member 101 as seen in FIG. 2). The movement 110 is held in this cavity 104.

A signal reflection surface 105 is formed flush with the solar panel support substrate 120 described below on the end of the case member 101 where the open face 103 is formed. As described above, the case member 101 is made from an electrically conductive material, and when RF signals enter from the face or dial side of the timepiece, the incident signals can be reflected by this signal reflection surface 105.

The movement 110 displays the time by means of the hands 3 described above and receives signals from the GPS satellites 5*a*, 5*b*, 5*c*, 5*d*, and includes a circuit board 25 populated with circuit devices (such as IC chips) for processing the time display and GPS functions, a drive mechanism 19 including a wheel train and stepping motor for driving the hands 3, and a storage battery 24 that supplies power to other parts of the movement.

The circuit devices disposed to the circuit board 25 include a reception unit 18 for processing signals received from the GPS satellites 5*a*, 5*b*, 5*c*, 5*d*, and a control unit 20 for controlling the drive mechanism 19.

The GPS wristwatch 1 has the solar panel support substrate 120 disposed to the open face 103 of the cavity 104, and a solar panel 120A and the dial 2 are disposed on the face side of the solar panel support substrate 120.

The solar panel support substrate 120 is an electrically conductive plate made from brass, stainless steel, titanium alloy, or other electrically conductive metal material that is connected to the ground terminal of the circuit board 25, and thus functions as a ground plate (reflector) that reflects signals entering through the crystal 130 toward the GPS antenna 11.

The solar panel support substrate 120 is formed to a circular disk shape with a diameter slightly greater than the inside diameter of the case member 101 before being placed in the case 10. The solar panel support substrate 120 is press fit into the case member 101, and the outside edge of the solar panel support substrate 120 is therefore fixed tightly against the inside circumference surface of the case member 101.

A notched part 121 (a "through-hole" according to the invention) connecting the space on the crystal 130 side with the space on the movement 110 side is formed in one location near the outside edge of the solar panel support substrate 120, and more particularly near 9:00 o'clock in this embodiment of the invention.

The solar panel 120A is affixed to the face side of the solar panel support substrate 120, and power is produced from light incident to the crystal 130 side. This solar panel 120A is connected to a charging control circuit 51 (see FIG. 5), and the power generated by the solar panel 120A is passed through this charging control circuit 51 and appropriately charged to the storage battery 24.

The dial 2 is disposed to the outside surface of the solar panel 120A. The outside diameters of the dial 2 and the solar panel 120A are matched to the inside diameter of a dial ring 140, the outside edge of each is disposed to the inside surface of the dial ring 140 with no gap therebetween, and the solar panel support substrate 120 cannot be seen from the outside.

The dial 2 is made from polycarbonate or other non-conductive plastic material, is transparent, and does not interfere with light passing through to the solar panel 120A.

The hands 3 described above are disposed on the outside surface side of the dial 2 (the top as seen in FIG. 2), and the movement 110 is disposed on the back cover side of the solar panel support substrate 120 (the bottom as seen in FIG. 2). Disposed to the movement 110 in layers sequentially from the solar panel support substrate 120 side to the back cover 102 side are the drive mechanism 19, circuit board 25, and storage battery 24. Of the circuit devices disposed to the circuit board 25, the reception unit 18 is disposed in the middle of the circuit board 25 on the opposite side of the circuit board 25 (that is, on the back cover side) as the GPS antenna 11 and LCD display 4 in order to avoid the effects of noise. The control unit 20 is disposed to the circuit board 25 on the solar panel support substrate 120 side thereof.

The GPS antenna 11 of the GPS wristwatch 1 is disposed along the outside circumference of the solar panel support substrate 120.

The GPS antenna 11 receives signals from the GPS satellites 5*a*, 5*b*, 5*c*, 5*d* described above, is disposed on the dial side of the solar panel support substrate 120, and is configured so that the outside edge of the GPS antenna 11 substantially conforms to the shape of the outside edge of the solar panel support substrate 120 (see FIG. 3). The GPS antenna 11 is described in further detail below.

The GPS wristwatch 1 has a dial ring 140 in which the GPS antenna 11 is housed.

The dial ring 140 is ring shaped with an outside diameter matching the dial 2, and has a channel in which the GPS antenna 11 is held along the outside circumference. The inside circumference of the dial ring 140 is a conical surface that slopes toward the dial 2, and has a scale with 60 equally spaced markers printed on this sloped surface.

A bezel 150 is disposed to the outside circumference of the dial ring 140, and the crystal 130 that covers the hands 3 and the face of the dial 2 is disposed on the inside of the bezel 150.

The bezel 150 is a ring with the outside circumference continuous to the outside circumference of the case member 101, and is attached to the case member 101 of the case 10 by means of double-sided adhesive tape, adhesive, or an interlocking ridge and channel configuration rendered on opposing mating surfaces, for example. The bezel 150 holds the crystal 130 and presses and holds the dial ring 140 against the dial 2.

The crystal 130 is thus disposed covering the dial side of the movement 110, a solar panel support substrate 120 that functions as a ground plate is disposed between the crystal 130 and the movement 110, and the hands 3 and GPS antenna 11 are disposed between the solar panel support substrate 120 and the crystal 130.

The case member 101 and the back cover 102 of the case 10 in the GPS wristwatch 1 according to this embodiment of the invention are made from a metal material with outstanding appearance, and the surfaces thereof are given an appropriate surface finish.

The dial ring 140 and bezel 150 are made of non-conductive materials, the crystal 130 is also made from a non-conductive glass-like material, and these members therefore do not function as electromagnetic shields adversely affecting the GPS antenna 11 disposed to the outside circumference part of the solar panel support substrate 120 on the dial side.

GPS Antenna

As shown in FIG. 4, the GPS antenna 11 has a ring-shaped dielectric substrate 111 that is rectangular in section, and an antenna electrode 112 disposed to the surface thereof.

The dielectric substrate 111 has a function that shortens the signal wavelength. More specifically, the satellite signals transmitted from the GPS satellites 5*a*, 5*b*, 5*c*, 5*d* are circularly polarized waves with a frequency of 1575.42 MHz and wavelength of 19 cm, and the circumferential length of the antenna electrode 112 must be 1.0 to 1.4 times the wavelength of the received satellite signals in order to receive such satellite signals with a loop antenna. However, by disposing the antenna electrode 112 on the dielectric substrate 111, the dielectric substrate 111 can shorten the wavelength of the satellite signals, and the shortened wavelength can be received by the antenna electrode 112.

Note that for a dielectric substrate 111 with a relative static permittivity of $\in_r$, the signal wavelength shortening ratio is $1/(\in_r)^{1/2}$. Therefore, to receive satellite signals with a wavelength of 19 cm using the antenna electrode 112 of a loop antenna with an approximately 3 cm diameter (approximately 9.4 cm circumferential length), a dielectric substrate 111 with relative static permittivity $\in_r$ of 4 to 10 may be used. Examples of such materials include ceramics of which alumina ($\in_r$=8.5) is a main component, ceramics such as Micalex ($\in_r$=6.5-9.5) containing mica, glass ($\in_r$=5.4-9.9), and diamond ($\in_r$=5.68).

The height of the dielectric substrate 111, that is, the distance (height) from the bottom surface facing the solar panel support substrate 120 to the top surface facing the crystal 130, may be suitably set to the distance required for the solar panel support substrate 120 to function as a ground plate for the antenna electrode 112. More specifically, if the height from the solar panel support substrate 120 to the antenna electrode 112 is from 0.05 to 0.01 times the wavelength received by the antenna electrode 112, that is, the signal wavelength after wavelength shortening by the dielectric substrate 111, signals reflected by the solar panel support substrate 120 can be desirably received by the antenna electrode 112. For example, if the relative permittivity $\in_r$ of the dielectric substrate 111 is 10, satellite signals with a wavelength of 19 cm are shortened to a wavelength of approximately 4.25 cm by the dielectric substrate 111. In this configuration the antenna electrode 112 can desirably receive the signals reflected by the solar panel support substrate 120 if the distance from the solar panel support substrate 120 to the antenna electrode 112 is 0.21 cm to 0.42 cm, or 0.05 to 0.1 times the shortened wavelength.

Note that in the GPS wristwatch 1 according to this embodiment of the invention the height of the dielectric substrate 111 is set to 0.3 cm.

The antenna electrode 112 can be rendered in unison with the dielectric substrate 111 by, for example, printing a copper, silver, or other conductive material on the surface of the dielectric substrate 111, or by bending and affixing a conductive metal plate of copper or silver, for example, on the surface of the dielectric substrate 111. Note, further, that a pattern may be rendered on the surface of the dielectric substrate 111.

The antenna electrode 112 includes the main antenna unit 113, a coupling unit 114, and a power supply unit 115.

The main antenna unit 113 is the ring-shaped part disposed on the surface of the dielectric substrate 111, and receives signals entering through the crystal 130 or reflected by the solar panel support substrate 120. A junction node 116 is formed at a place on the inside circumference part of the main antenna unit 113, and the coupling unit 114 is rendered extending from this junction node 116 to the inside circumference side of the dielectric substrate 111. The coupling unit 114 is formed in the circumferential direction along the inside circumference side of the dielectric substrate 111. The distal end of the coupling unit 114, that is, the opposite end as the end connected to the junction node 116, extends toward the bottom of the dielectric substrate 111, and the power supply unit 115 connected to the coupling unit 114 is formed on the bottom side of the dielectric substrate 111.

As shown in FIG. 2, the power supply unit 115 is formed at a position opposite the notched part 121 of the solar panel support substrate 120 at the 9:00 o'clock position, and the end part of a connection pin 61 (rendering the connection member of the invention) passing through the notched part 121 contacts the power supply unit 115 at one point (power supply node 117). The length from the junction node 116 through the coupling unit 114 to the power supply node 117 is approximately ¼ of the wavelength of the signals received by the GPS antenna 11, and is, for example, 1.06 cm when the dielectric substrate 111 has a relative permittivity $\in_r$ of 10.

The connection pin 61 that touches the power supply node 117 of the power supply unit 115 is supported so that it can rise freely in a connector base part 62 standing at the 9:00 o'clock position. By thus disposing the connection pin 61 at 9:00 o'clock, structural interference with the crown 6 disposed at 3:00 o'clock and the buttons 7 and 8 disposed at 2:00 o'clock and 4:00 o'clock as external operating members can be avoided.

In addition, the connection pin 61 and connector base part 62 are electrically connected, and the connector base part 62 is connected to the reception unit 18. The connector base part 62 is basically cylindrically shaped, and a coil spring or other urging member disposed inside the cylinder urges the connection pin 61 to the power supply unit 115 side. As a result, the connection pin 61 is pressed against the power supply node 117, and the connection between the connection pin 61 and power supply node 117 is maintained even when the GPS wristwatch 1 is subject to shock.

As shown in FIG. 4, the connector base part 62 is connected to a connection node 251 in the middle of the circuit board 25 by a wire lead, and is connected at this connection node 251 to the reception unit 18 disposed on the back cover 102 side of the circuit board 25. Note that in order for a single wavelength loop antenna such as the GPS antenna 11 in this embodiment of the invention to efficiently receive circularly polarized waves, the connection node 251 is preferably located in the middle part of the circuit board 25.

On the other hand, when the connection node 251 is thus disposed in the middle of the circuit board 25, the wiring becomes longer and signal loss increases. In order to solve this problem, a low noise amplifier (LNA) may be disposed between the GPS antenna 11 and the reception unit 18, and more particularly between the GPS antenna 11 and a filter (SAW) 31 described below (see FIG. 5), to compensate for signal loss.

Note that the method of connecting the connector base part 62 and the reception unit 18 is not limited to the foregoing. For example, the connector base part 62 may be connected to a printed circuit on the circuit board 25 and connected to the reception unit 18 through this printed circuit.

In this embodiment of the invention the solar panel support substrate 120 also serves as a ground plate and functions as the ground plate of the GPS antenna 11.

In general, the antenna ground plate is as large as possible, and the length of one side if the ground plate is rectangular or the outside diameter (the diameter of the outside circumference) if the ground plate is round is preferably at least ¼ of the wavelength of the signals that are sent and received by the antenna.

In this embodiment of the invention the outside diameter of the solar panel support substrate 120 used as the ground plate is preferably 48 mm or more in order to receive signals from the GPS satellites. However, the outside diameter of the dial 2 used in a wristwatch is typically 35 mm, and the required 48 mm diameter cannot be obtained. To compensate for this deficiency, this embodiment of the invention uses a configuration that has a signal reflection surface 105 formed flush with the solar panel support substrate 120 at the top end part of the case member 101, and this signal reflection surface 105 and solar panel support substrate 120 together function as the ground plate.

As described above, the solar panel support substrate 120 is press fit into the case member 101, rendering the outside circumference edge of the solar panel support substrate 120 and the inside circumference surface of the case member 101 in contact with no gap between the solar panel support substrate 120 and case member 101, thereby increasing the area that can be made to function as the ground plate. As a result, incident signals can be more efficiently reflected to the GPS antenna 11, and antenna characteristics can be improved.

Furthermore, the signal reflection surface 105 of the case member 101 is rendered flush with the solar panel support substrate 120 in this embodiment of the invention, but the invention is not so limited. More specifically, if the distance from the signal reflection surface 105 to the top of the dielectric substrate 111 is between 0.05 to 0.01 times the wavelength (the signal wavelength after wavelength shortening by the dielectric substrate 111) of the signals received by the antenna electrode 112, signals reflected by the signal reflection surface 105 can be desirably received by the main antenna unit 113.

Note that a LCD panel is disposed on the back side of the dial 2 as the display 4, and this LCD panel is covered by a shield plate to shield the effects of noise. By using the solar panel support substrate 120 as a ground plate in this configuration, a shield effect is also achieved around the display 4.

Furthermore, the stepping motor of the drive mechanism 19 is also a source of noise, but because the drive mechanism 19 is located on the opposite side of the solar panel support substrate 120 as the GPS antenna 11, it is shielded by the solar panel support substrate 120 and its effect on the GPS antenna 11 is thereby suppressed.

Furthermore, because the case 10 including the back cover 102 and case member 101 is metal, the effect of the user's arm on the GPS antenna 11 can also be avoided. More specifically, if the case 10 is a plastic case, the resonance frequency of the antenna differs when the timepiece is worn and when it is not worn due to the effect of the nearby arm, resulting in an undesirable performance difference. However, because the case 10 is metal in this embodiment of the invention, the effect of the arm can be avoided by the shield effect of the metal case, there is substantially no difference in antenna performance in this embodiment when the timepiece is worn and when it is not worn, and stable reception performance can be achieved.

Circuit Configuration of a GPS Wristwatch

The circuit configuration of the GPS wristwatch 1 according to this embodiment of the invention is described next. As shown in FIG. 5 the GPS wristwatch 1 has a GPS antenna 11, filter (SAW) 31, reception unit 18, display control unit 40, and power supply unit 50.

The filter (SAW) 31 is a bandpass filter that extracts 1.5 GHz satellite signals. A low noise amplifier (LNA) as described above may also be disposed to improve reception sensitivity between the GPS antenna 11 and the filter 31.

Note, further, that the filter (SAW) 31 may be incorporated in the reception unit 18.

The RF unit 27 includes a PLL (phase locked loop) circuit 34, an IF filter 35, a VCO (voltage controlled oscillator) 41, an A/D converter 42, a mixer 46, a low noise amplifier (LNA) 47, and an IF (intermediate frequency) amplifier 48.

The satellite signal extracted by the SAW filter 31 is amplified by the LNA 47, then mixed by the mixer 46 with a signal from the VCO 41 and down-converted to a signal in the intermediate frequency band. The IF signal mixed by the mixer 46 passes through the IF amplifier 48 and IF filter 35, and is converted to a digital signal by the A/D converter 42.

The baseband unit 30 includes a DSP (digital signal processor) 39, CPU (central processing unit) 36, and SRAM (static random access memory) 37. A TXCO (temperature-compensated crystal oscillator) 32 and flash memory 33 are also connected to baseband unit 30.

Digital signals from the A/D converter 42 of the RF unit 27 are input to the baseband unit 30, which based on a control signal processes the satellite signals and acquires the satellite time information and positioning information.

Note that the clock signal for the PLL circuit 34 is generated by the TXCO 32.

The display control unit 40 includes a control unit (CPU) 20 and a drive circuit 43 that drives the hands 3 and the LCD display 4.

The hardware components of the control unit 20 include a real-time clock (RTC) 20A and storage unit 20B.

The real-time clock 20A keeps the internal time information using a reference signal output from a crystal oscillator.

The storage unit 20B stores time data and positioning data output from the reception unit 18. Time difference data correlated to the positioning information is also stored in the storage unit 20B, and the local time at the current location can be calculated from the time difference data and the internal time information kept by the real-time clock 20A.

The GPS wristwatch 1 according to this embodiment of the invention can automatically adjust the time by means of the reception unit 18 and the display control unit 40 based on the signals received from the GPS satellites.

The power supply unit 50 includes the solar panel 120A, charging control circuit 51, storage battery 24, a first regulator 52, a second regulator 53, and a voltage detection circuit 54.

The storage battery 24 supplies drive power to the display control unit 40 through the first regulator 52, and supplies drive power to the reception unit 18 through the second regulator 53.

The solar panel 120A supplies power to the storage battery 24 through the charging control circuit 51, and charges the storage battery 24.

The voltage detection circuit 54 monitors the voltage of the storage battery 24, and outputs to the control unit 20. The control unit 20 can therefore determined the storage battery 24 voltage and control the reception process.

As described above, the GPS wristwatch 1 according to a first embodiment of the invention has a solar panel support substrate 120 that functions as a ground plate between the crystal 130 and the movement 110. In addition, a GPS antenna 11 with a dielectric substrate 111 and a ring-shaped antenna electrode 112 formed on the surface of the dielectric substrate 111 is disposed between the solar panel support substrate 120 and the crystal 130.

As a result, satellite signals entering from the crystal side can be reflected by the solar panel support substrate 120 with a relatively large surface area disposed on the crystal 130 side and input to the antenna electrode 112, thereby assuring good antenna performance. In addition, because the antenna electrode 112 rendering a ring-shaped main antenna unit 113 is formed on the ring-shaped dielectric substrate 111, the signal reception area of the antenna electrode 112 can be increased and the reception sensitivity of the antenna can be improved.

Furthermore, because the antenna electrode 112 can be rendered with a large signal reception area, the dielectric substrate 111 can be made from a wider selection of materials and designing the GPS antenna 11 can be made easier. More specifically, the antenna electrode 112 must be at least as long as the wavelength of the signals to be received, and if the length of the antenna electrode 112 is short, a dielectric substrate 111 with relative static permittivity great enough to shorten the signal wavelength according to length of the antenna electrode 112 is required. This narrows the selection of materials usable for the dielectric substrate 111, and increases cost. However, by using a ring-shaped antenna electrode 112 as described in this embodiment of the invention, sufficient circumferential length can be assured and the dielectric substrate 111 can be selected from a wider range of materials. A suitably lower cost dielectric substrate 111 can therefore be selected, which is beneficial for production.

In addition, a metal case member 101 and back cover 102 can be used for the case 10, and a high quality appearance can be achieved for the timepiece.

The GPS wristwatch 1 according to this embodiment of the invention also uses a solar panel support substrate 120 as a conductive plate supporting the solar panel 120A.

With this configuration the solar panel support substrate 120 can be used as a ground plate and as a support substrate for the solar panel 120A, and using a dedicated substrate to support the solar panel 120A and a separate substrate that functions as a conductive plate is not necessary. An increase in the parts count can therefore be suppressed and the configuration can be simplified.

A signal reflection surface 105 is also formed flush with the solar panel support substrate 120 on the open face 103 side of the case member 101 of the GPS wristwatch 1. The solar panel support substrate 120 is press fit into the inside circumference side of the case member 101, thereby disposing the outside edge thereof against the inside circumference surface of the case member 101.

As a result, the ground plate can be rendered by the signal reflection surface 105 and the solar panel support substrate 120 together. In addition, because there is no gap between the signal reflection surface 105 and solar panel support substrate 120, signals can be reflected without leaking from the crystal 130 side to the movement 110 side.

As also described above, the antenna electrode 112 of the GPS antenna 11 includes a ring-shaped main antenna unit 113 disposed on the top surface of the ring-shaped dielectric substrate 111, a coupling unit 114 that follows the inside surface of the dielectric substrate 111 from a junction node at one point on the inside circumference edge of the main antenna unit 113, and a power supply unit 115 that is contiguous to the opposite end of the coupling unit 114 as the junction node 116 and is formed on the bottom side of the dielectric substrate 111. A notched part 121 is disposed in the solar panel support substrate 120 at a position opposite the power supply unit 115, and a connection pin 61 is disposed passing through the notched part 121 and urged from the movement 110 side toward the power supply point 117.

As a result, contact between the power supply unit 115 and the solar panel support substrate 120, and contact between the connection pin 61 and the solar panel support substrate 120, can be prevented while the antenna electrode 112 and the reception unit 18 of the circuit board 25 can be reliably electrically connected by means of the connection pin. In addition, because the connection pin 61 is urged to the power supply point 117 side, the connection pin 61 and power supply point 117 can be held desirably connected even when the timepiece is subject to shock.

The reception unit 18 is disposed on the back cover 102 side of the circuit board 25, and the solar panel support substrate 120 used as a ground plate is disposed between the reception unit 18 and the GPS antenna 11. As a result, the solar panel support substrate 120 functions as a shield against noise output from the internal clock of the reception unit 18. The GPS antenna 11 is therefore not exposed to the effects of noise from the reception unit 18, and antenna performance can be improved.

The GPS antenna 11 is disposed on the face side of the dial 2, and the surrounding dial ring 140 and bezel 150 are made from a non-conductive material. As a result, the GPS antenna 11 is not subject to electromagnetic shielding even if the case 10 is made from a metal material with an outstanding appearance, and good antenna performance can be assured.

In addition, because the case member 101 and back cover 102 of the case 10 are metal, antenna matching is not affected by the GPS wristwatch 1 being worn on the wrist, the difference between antenna characteristics when the timepiece is worn and not worn is less, and stable signal reception is possible.

Embodiment 2

Figure 6:
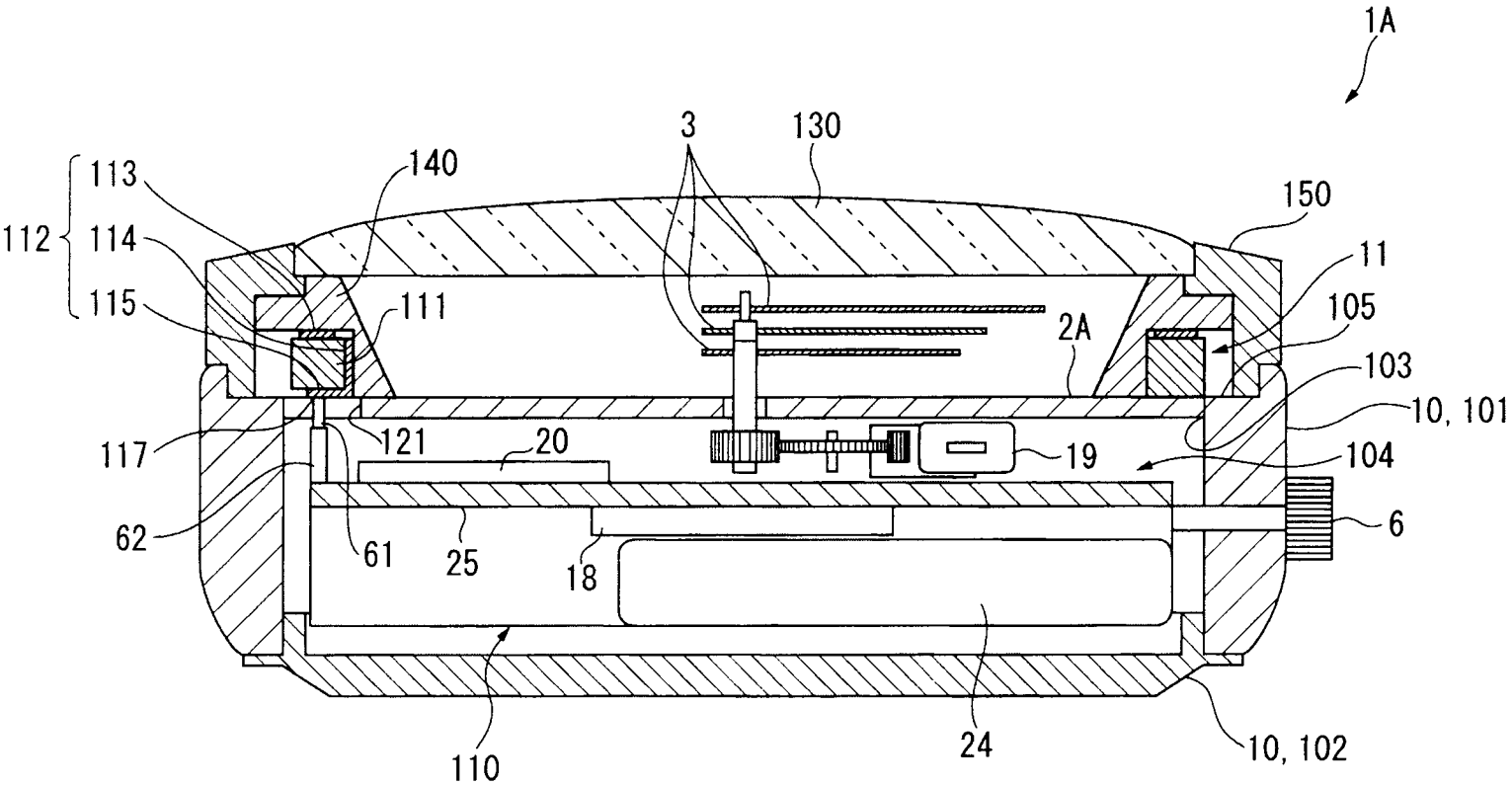
FIG. 6 is a sectional view of a GPS timepiece according to a second embodiment of the invention.
Figure 7:
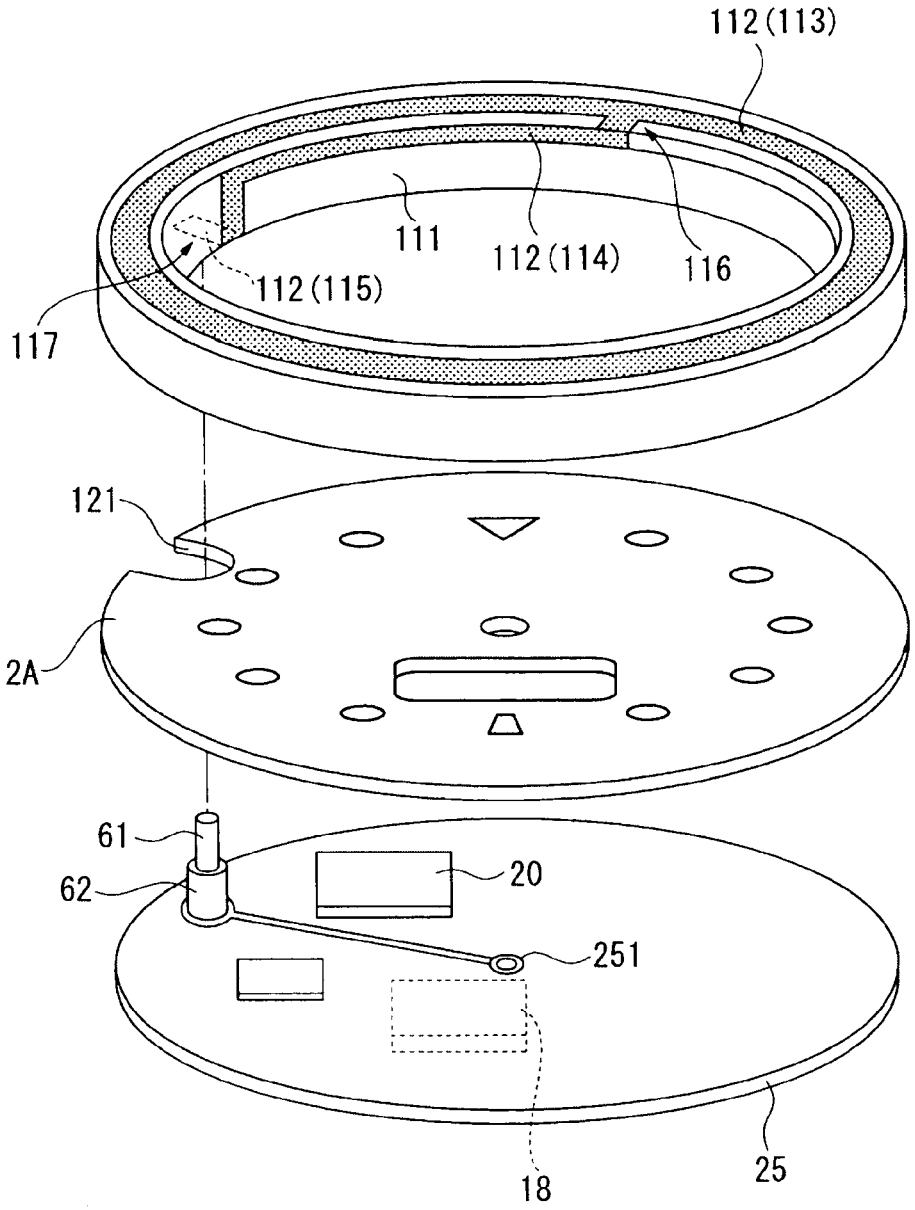
FIG. 7 is an oblique exploded view of the GPS antenna disposed in a GPS wristwatch according to a second embodiment of the invention.

A GPS wristwatch according to a second embodiment of the invention is described next. FIG. 6 is a sectional view of a GPS timepiece according to a second embodiment of the invention. FIG. 7 is an oblique exploded view of the timepieces antenna in the second embodiment.

Note that the configuration of the GPS wristwatch 1A according to the second embodiment of the invention is substantially the same as the first embodiment described above, and further detailed description of common components is omitted below for brevity.

In the first embodiment the solar panel support substrate 120 functions as a conductive plate according to the invention and the solar panel support substrate 120 reflects incident signals to the GPS antenna 11.

In this second embodiment of the invention as shown in FIG. 6 and FIG. 7, the solar panel 120A and solar panel support substrate 120 are omitted, and the dial 2A functions and the conductive plate of the invention, that is, as the ground plate.

More specifically, the dial 2A of the GPS wristwatch 1A according to the second embodiment of the invention is made slightly larger than the inside dimensions of the case member 101 and is press fit to the inside circumference of the case member 101. The dial 2A is made from brass, stainless steel, titanium alloy, or other type of metal. The surface of the dial 2A may be finished with an appropriate surface process such as painting, plating, or sputtering in order to improve the appearance.

In this configuration the dial 2A is disposed to the open face 103 of the case member 101, functions as a ground plate, and reflects signals entering from the crystal 130 to the main antenna unit 113 of the antenna electrode 112 to improve antenna performance.

This embodiment of the invention has the same effects as the first embodiment described above. More specifically, the dial 2A that functions as a ground plate is disposed between the crystal 130 and the movement 110, and a GPS antenna 11 with a dielectric substrate 111 and antenna electrode 112 formed on the surface of the dielectric substrate 111 is disposed between the dial 2A and the crystal 130.

As a result, satellite signals entering from the crystal side can be reflected by the dial 2A with a relatively large surface area disposed on the crystal 130 side and input to the antenna electrode 112, thereby assuring good antenna performance. In addition, because the antenna electrode 112 rendering a ring-shaped main antenna unit 113 is formed on the ring-shaped dielectric substrate 111, the signal reception area of the antenna electrode 112 can be increased and the reception sensitivity of the antenna can be improved.

Furthermore, because the dial 2A needs sufficient conductivity to function as a ground plate, it can be made from a metal material with a high quality appearance. In addition, because the GPS antenna 11 is disposed around the outside of the dial 2A, the display area of the dial 2A will not be hidden even if the GPS antenna 11 is covered with the dial ring 140. As a result, the appearance of the GPS wristwatch 1A can be improved.

The construction of the GPS wristwatch 1A in this embodiment of the invention can also be simplified because the dial 2A also functions as the ground plate.

Embodiment 3

Figure 8:
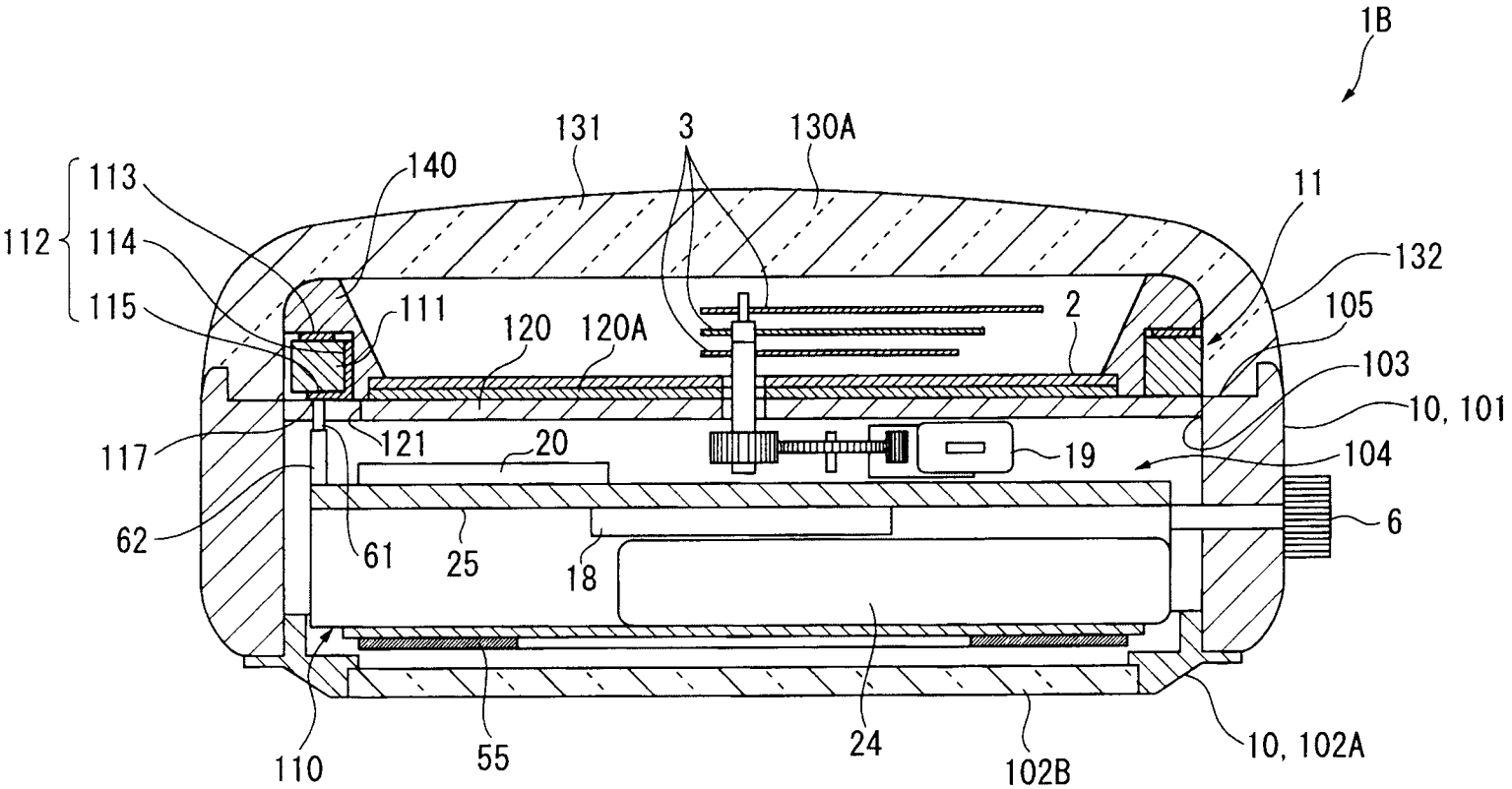
FIG. 8 is a sectional view of a GPS timepiece according to a third embodiment of the invention.

A GPS wristwatch 1B according to a third embodiment of the invention is described next. FIG. 8 is a sectional view showing the configuration of the GPS wristwatch 1B according to the third embodiment of the invention.

Note that the configuration of the GPS wristwatch 1B according to the third embodiment of the invention is substantially the same as the first embodiment described above, and further detailed description of common components is omitted below for brevity.

In the GPS wristwatches 1 and 1A according to the first and second embodiments of the invention described above, a bezel 150 is disposed to one side of the case member 101 with the bezel 150 holding the crystal 130. In this third embodiment of the invention as shown in FIG. 8, however, the crystal 130A is disposed directly to the case member 101.

The crystal 130A used in this embodiment of the invention is manufactured to a bowl-shaped configuration having a face part 131 that covers the face of the timepiece, and a cylindrical side part 132 formed around the outside edge of the face part 131, by cutting and polishing a glass plate. A ridge and channel part is formed on the end of the side part 132 of the crystal 130A, and the crystal 130A is attached to the case 10 by fitting this ridge and channel part to a matching ridge and channel part formed on the end of the case member 101, thereby covering the side surface of the GPS antenna 11 from the face. The end face of the side part 132 of the crystal 130A is formed so that it extends to the side of the movement 110 from the top of the GPS antenna 11 where the main antenna unit 113 is disposed. More specifically, the end of the side part 132 is formed to be at substantially the same elevation as the surface of the solar panel support substrate 120 when affixed to the case member 101.

Note that as in the first and second embodiments of the invention the GPS antenna 11 cannot be seen from the outside in this third embodiment of the invention because the GPS antenna 11 is covered by the dial ring 140, but printing may be applied to the inside surface of the crystal 130A at a position overlapping the GPS antenna 11 so that the GPS antenna 11 cannot be seen from the outside. A non-conductive ink is used for printing in this configuration so that the reception performance of the antenna is not affected.

The GPS wristwatch 1B according to the third embodiment of the invention also has a charging coil 55 disposed opposite the back cover 102 so that the battery can be charged from an external charger by means of electromagnetic induction. To enable effective charging by means of electromagnetic induction, the back cover 102 has an annular first back cover part 102A made of metal, and a disk-shaped second back cover part 102B made of glass that is held by the first back cover part 102A. Note that the storage battery 24 is charged by both the charging coil 55 and the solar panel 120A in this configuration, but the battery may be charged using only the solar panel 120A as described in the first embodiment above, or by only the charging coil 55. When only the charging coil 55 is used for charging, the dial 2A may be used as a conductive plate as described in the second embodiment above.

In addition to the effects of the first embodiment described above, this embodiment of the invention reduces the parts count by the omission of the bezel 150. In addition, while the surface of a ceramic bezel 150 is easily scratched and the appearance therefore deteriorates over time, this deterioration in appearance over time can be prevented in this embodiment of the invention because the case member 101 is covered by scratch-resistant glass.

In addition, this embodiment of the invention can achieve the luxury feel that is unique to glass by covering the entire face side of the GPS wristwatch 1 with the crystal 130A instead of using a crystal 130 that is disposed through a separate intervening member such as the bezel 150.

Furthermore, because the crystal 130A is formed to cover the top from the sides of the GPS antenna 11, signals input from the side of the GPS wristwatch 1B can also be received by the GPS antenna 11.

Other Embodiments

The invention is not limited to the embodiments described above and can be varied in many ways without departing from the scope of the accompanying claims.

Figure 9A:
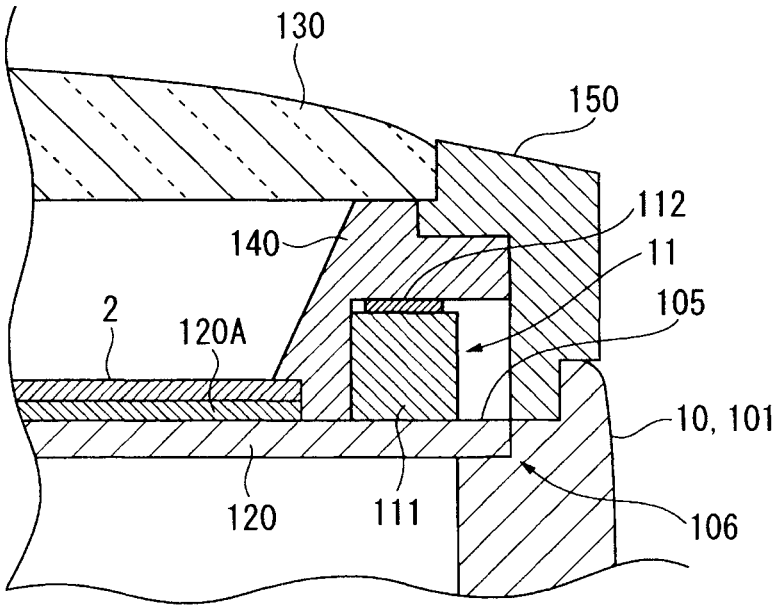
FIGS. 9A and 9B are sectional views of a part of a GPS timepiece according to another embodiment of the invention.

For example, the first to third embodiments above describe configurations in which the outside diameter of the solar panel support substrate 120 and dial 2A used as a conductive plate substantially matches the outside edge of the GPS antenna 11, but the invention is not so limited. More particularly, as shown in FIG. 9A, the outside diameter of the solar panel support substrate 120 used as a conductive plate may be further increased, and the GPS antenna 11 may be disposed on the inside circumference side of the outside edge of the solar panel support substrate 120. In this configuration a shoulder 106 that holds the outside edge of the solar panel support substrate 120 is disposed to the case member 101, and the solar panel support substrate 120 is disposed substantially flush with the signal reflection surface 105 of the case member 101 by press fitting the solar panel support substrate 120 into this shoulder 106.

Figure 9B:
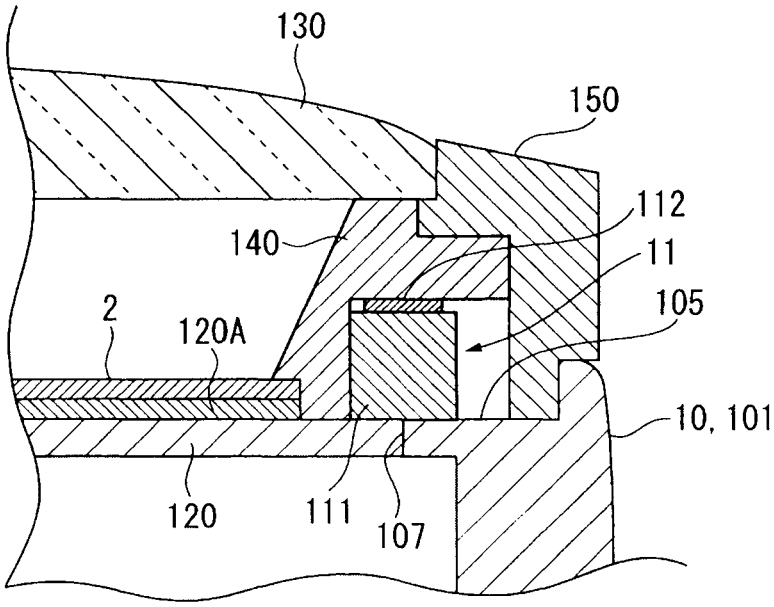
Figure 10:
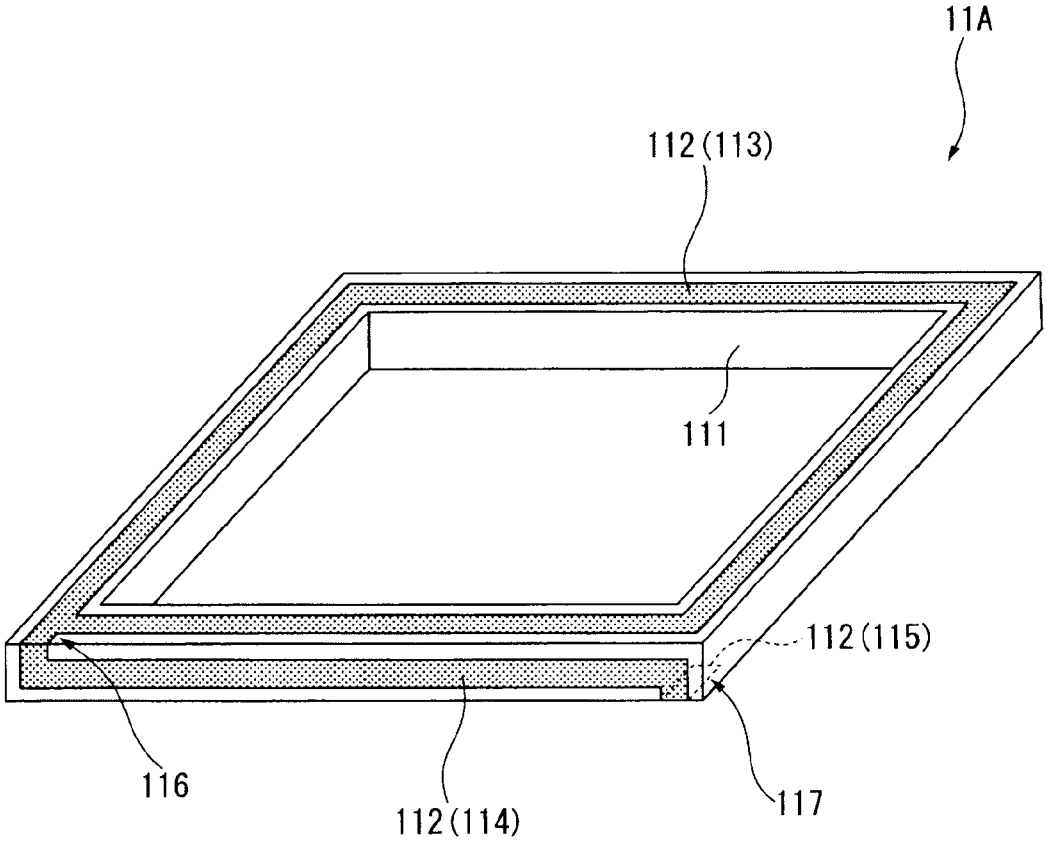
FIG. 10 shows an example of a GPS antenna in another embodiment of the invention.

Further alternatively, the outside diameter of the solar panel support substrate 120 used as the conductive plate may be reduced as shown in FIG. 9B. In this configuration the signal reflection surface 105 of the case member 101 is extended to the inside of the timepiece, and the outside edge of the solar panel support substrate 120 is fit to the inside circumference surface rendered by the distal end face 107 of the signal reflection surface 105. As a result, there is no gap between the signal reflection surface 105 and the solar panel support substrate 120, and good antenna performance can be achieved.

Each of the first to third embodiments above describes a GPS wristwatch 1, 1A, 1B that is substantially round in plan view and has a ring-shaped GPS antenna 11 conforming to the shape of the wristwatch, but the invention is not so limited. For example, some GPS wristwatches with a digital display are substantially square or rectangular when seen in plan view. A ring-shaped GPS antenna 11 may be disposed inside such a timepiece, or a rectangular GPS antenna 11A matching the shape of the timepiece may be used instead. By using such a rectangular GPS antenna 11A, the circumferential length of the antenna electrode 112 can be increased compared with a configuration having a ring-shaped GPS antenna 11 disposed in a rectangular timepiece, and better antenna performance can be achieved. In addition, by using a rectangular GPS antenna 11A in a rectangular timepiece, the space inside the timepiece can be used more effectively to, for example, increase the display area of the digital display.

Figure 11:
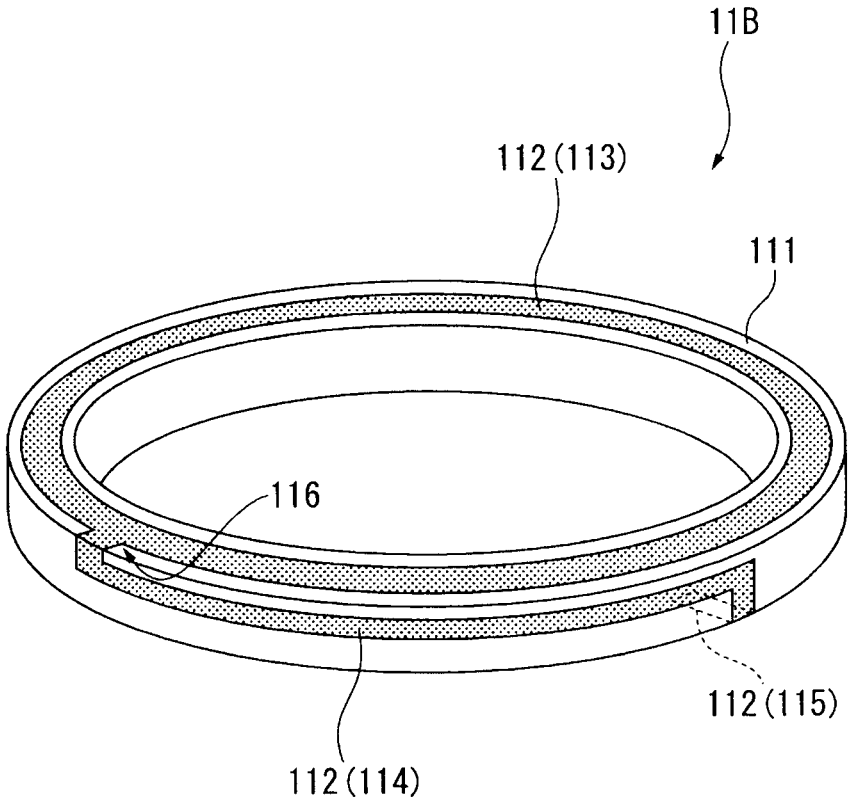
FIG. 11 shows an example of a GPS antenna in another embodiment of the invention.

Furthermore, a configuration having the coupling unit 114 disposed along the inside surface of the dielectric substrate 111 from the junction node 116 of the main antenna unit 113 is described by way of example as the GPS antenna 11 above, but the invention is not so limited. For example, as shown in the GPS antenna 11B in FIG. 11, a configuration having the junction node 116 disposed to the outside circumference side of the main antenna unit 113, and the coupling unit 114 formed extending from this junction node 116 to the outside circumference side of the dielectric substrate 111 and continuing circumferentially along the outside surface is also conceivable.

Figure 12:
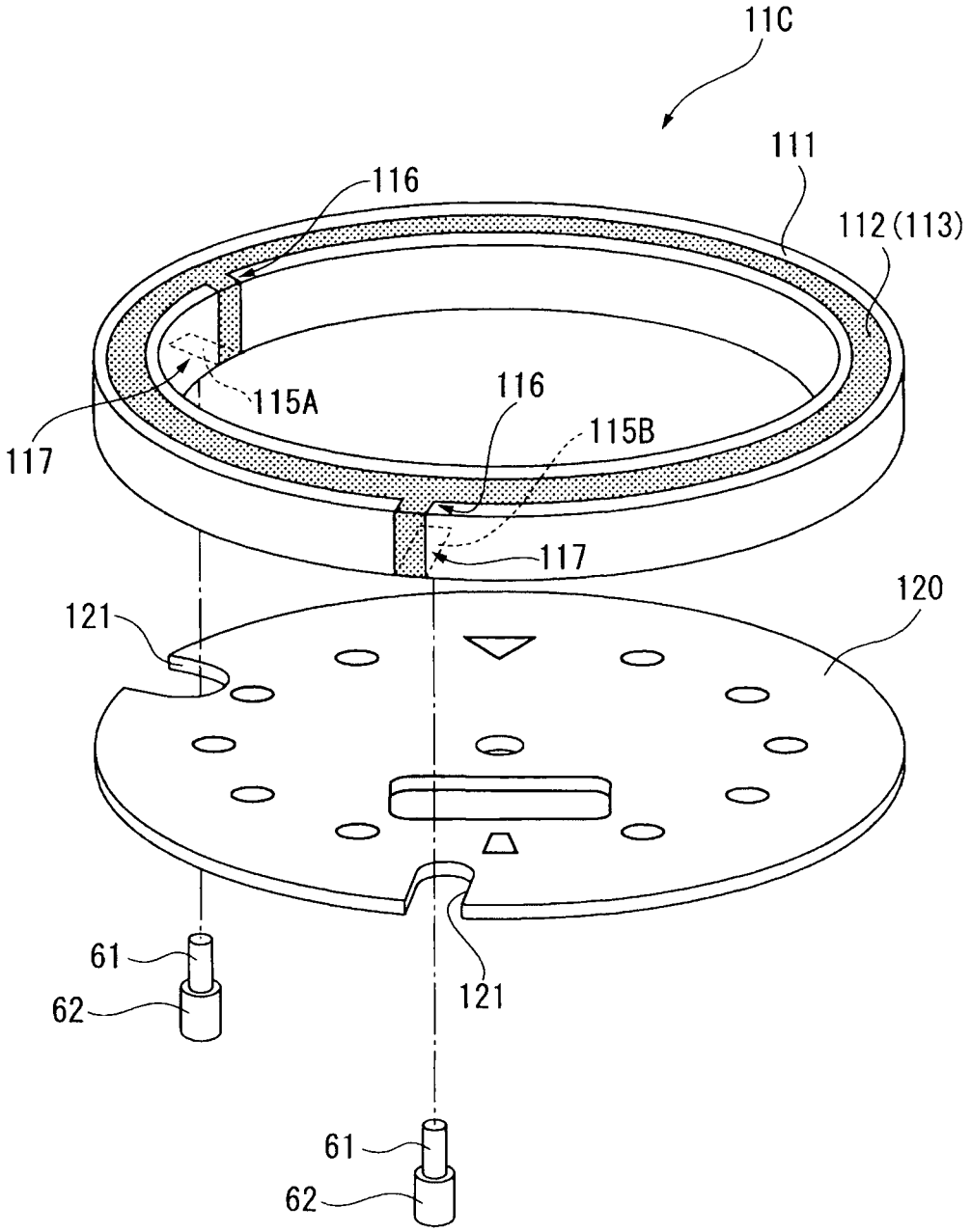
FIG. 12 shows an example of a GPS antenna in another embodiment of the invention.

Yet further, the first to third embodiments above describe a GPS antenna 11 having a single power supply unit 115, but a GPS antenna 11C having a plurality of power supply units 115 as shown in FIG. 12 is also conceivable. The GPS antenna 11C shown in FIG. 12 has two power supply units 115A and 115B disposed to the ring-shaped main antenna unit 113. In this configuration power supply unit 115A and power supply unit 115B are disposed so that the phase difference therebetween is 90°, rendering two orthogonal power supply points. There are therefore also two connection pins 61 corresponding to the two power supply units 115A and 115B of this GPS antenna 11C, and the satellite signals are transmitted from these two connection pins 61 to the circuit board 25. The circuit board 25 executes a reception process for circularly polarized waves by adjusting the phase difference of these two paths and inputting the signals to the reception unit 18.

A loop antenna having a ring-shaped main antenna unit 113 is described as an example of the GPS antenna 11 above, but the invention is not so limited. The main antenna unit 113 may, for example, be C-shaped. Circularly polarized waves can also be received with this configuration by rendering the junction node 116 connected to the coupling unit 114 at a position ¼ wavelength from one end of the C-shaped main antenna unit.

A connection pin 61 is described as an example of a connection member that contacts the power supply unit 115 above, but the invention is not limited to such pin members. For example, a contact plate rendered like a flat spring may be used as the connection member. In such a configuration the urging force of the flat spring assures that the contact plate contacts the power supply point 117 with a specific contact pressure.

A combination timepiece having both hands 3 and a display 4 is described by way of example as the GPS wristwatch 1 according to the invention, but the invention is not so limited. The invention can also be used advantageously in a digital timepiece having only a display, for example.

The invention is also not limited to wristwatches, and may be used in pocket watches and other types of timepieces, cell phones, digital cameras, portable digital assistant devices, and other types of devices with an electronic timepiece function.

The foregoing embodiments are described with reference to a GPS satellite as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The invention is also not limited to receiving satellite signals from positioning information satellites, and may be used with short-range receivers for receiving circularly polarized RF tags that use the 900 MHz band, for example.

The invention is also not limited to receiving circularly polarized waves, and may be used to receive linearly polarized waves.

The foregoing embodiments also have a dial ring 140 as a ring member covering the GPS antenna 11, but the invention is not so limited. More specifically, the ring member may be a member without indicia, and the inside surface may be perpendicular to the dial 2 or otherwise shaped instead of sloped.

The ring member is also not essential to the invention and a separate ring member can be omitted if the inside circumference of the bezel 150 protrudes to the inside and covers the GPS antenna 11.

The foregoing embodiments describe configurations in which a metal dial 2 functions as a ground plate or the solar panel support substrate 120 for the solar panel functions as a ground plate, but a discrete metal plate that is not also used as another functional member may be used instead and fit to the inside circumference surface of the case member 101.

The material of the conductive plate is also not limited to a metal material, and a metallic coating may be rendered on the surface of a plate made from a non-metallic material. Further alternatively, the conductive plate is not limited to a single contiguous member, and may be rendered from a plurality of small pieces forming a contiguous plate. Yet further alternatively, a substantially flat metal mesh material may be used.

Except for the GPS antenna 11, the members (bezel 150, crystal 130, dial ring 140) disposed more to the outside than the dial 2 or solar panel support substrate 120 used as the ground plate in the foregoing embodiments are made from a non-conductive material such as plastic or ceramic to avoid creating an electromagnetic shield, but it is not necessary to render all of these parts from non-conductive materials, and metallic materials may be used for parts of these elements. However, because electromagnetic shielding of the antenna increases with the increase in metallic materials, care must be taken to ensure antenna performance.

Note that metal may be used for the hands 3 because the area of the hands 3 is small, but the hands 3 are preferably made from a non-conductive material to avoid affecting the antenna.

Furthermore, the GPS antenna 11 has a ring-shaped dielectric substrate 111 in the foregoing embodiments, but a configuration not having a dielectric substrate 111 is also conceivable. More specifically, when receiving circularly polarized waves with a sufficiently short wavelength, the signals can be received directly by the antenna electrode 112 without shortening the signal wavelength. For such applications a configuration that does not have a dielectric substrate 111 and has only an antenna electrode 112, or a configuration that renders the antenna electrode 112 on an annular block that does not have a wavelength shortening function, for example, may be used.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A timepiece with a wireless function, comprising:
- a movement that is configured to display time;
- a conductive case that is configured to hold the movement;
- a crystal that is disposed at a face side of the conductive case and is configured to cover a face side of the movement;
- an antenna that has a substantially annular substrate and annular, conductive antenna electrode and is disposed between the movement and the crystal as seen in a lateral view;
- a ring member that is made of non-conductive material and is configured to cover the antenna; and
- a solar panel that is disposed at an inside area of the substantially annular substrate in lateral view.

2. A timepiece with a wireless function described in claim 1, wherein the ring member is a dial ring.

3. A timepiece with a wireless function described in claim 1, further comprising:
- a bezel that is made of non-conductive material and is disposed between the conductive case and the crystal.

4. A timepiece with a wireless function described in claim 1, wherein the antenna is formed in a ring shape.

5. A timepiece with a wireless function described in claim 1, wherein the antenna is formed in a rectangular shape.

6. A timepiece with a wireless function described in claim 1, wherein the antenna is formed in a shape that matches a shape of the timepiece.

7. A timepiece with a wireless function described in claim 1, wherein the crystal is attached to the conductive case and is formed so that it extends to a side of the movement from a location of the antenna where the antenna electrode is disposed.

8. A timepiece with a wireless function described in claim 7, wherein the crystal is printed to an inside surface at a position overlapping the antenna by a non-conductive ink.

9. A timepiece with a wireless function, comprising:

a dial;

a solar panel that is disposed at a back side of the dial;

a movement that is configured to display time and is disposed at a back side of the solar panel;

a conductive case that is configured to hold the movement;

a crystal that is disposed at a face side of the conductive case and is configured to cover a face side of the dial;

an antenna that has a substantially annular substrate and annular, conductive antenna electrode and is disposed between the movement and the crystal as seen in a lateral view; and a ring member that is made of non-conductive material and is configured to cover the antenna;

wherein the solar panel is disposed at an inside area of the substantially annular substrate in lateral view.

* * * * *